US009373427B2

(12) United States Patent
Seike

(10) Patent No.: US 9,373,427 B2
(45) Date of Patent: Jun. 21, 2016

(54) FLEXIBLE CIRCUITS

(75) Inventor: Aya Seike, Tokyo (JP)

(73) Assignee: Empire Technology Development LLC, Wilmington, DE (US)

( * ) Notice: Subject to any disclaimer, the term of this patent is extended or adjusted under 35 U.S.C. 154(b) by 349 days.

(21) Appl. No.: 13/582,009

(22) PCT Filed: Mar. 5, 2012

(86) PCT No.: PCT/US2012/027746

§ 371 (c)(1),
(2), (4) Date: Aug. 30, 2012

(87) PCT Pub. No.: WO2013/133792

PCT Pub. Date: Sep. 12, 2013

(65) Prior Publication Data

US 2013/0228370 A1 Sep. 5, 2013

(51) Int. Cl.

| | |
|---|---|
| ***H01B 1/00*** | (2006.01) |
| ***H01R 43/00*** | (2006.01) |
| ***H01B 1/22*** | (2006.01) |
| *H01R 39/64* | (2006.01) |

(52) U.S. Cl.
CPC ..... *H01B 1/22* (2013.01); *H01R 39/646* (2013.01); *Y10T 29/49117* (2015.01)

(58) Field of Classification Search
USPC ..... 174/9 F, 254; 29/825
See application file for complete search history.

(56) References Cited

U.S. PATENT DOCUMENTS

| | | | | |
|---|---|---|---|---|
| 3,518,461 A | | 6/1970 | Marks | |
| 3,599,038 A | * | 8/1971 | Skidmore | B05B 5/053 118/621 |
| 4,494,026 A | * | 1/1985 | Abe | 310/89 |
| 4,650,168 A | * | 3/1987 | Andra | F16F 13/20 267/140.13 |
| 5,581,192 A | * | 12/1996 | Shea | H01H 29/004 324/555 |
| 6,132,676 A | * | 10/2000 | Holzer | B22F 1/025 257/E23.009 |
| 6,794,021 B2 | | 9/2004 | Bader | |
| 7,780,622 B2 | | 8/2010 | Fitzpatrick et al. | |
| 2002/0047492 A1 | * | 4/2002 | Jones | 310/309 |
| 2005/0095866 A1 | * | 5/2005 | Toyoda | C23C 18/14 438/707 |
| 2006/0246331 A1 | * | 11/2006 | Steinbroner | H01M 8/249 429/416 |
| 2007/0036528 A1 | * | 2/2007 | Ferrone | A01K 7/027 392/480 |

(Continued)

FOREIGN PATENT DOCUMENTS

| | | |
|---|---|---|
| CN | 1369039 A | 9/2002 |
| CN | 102318179 | 1/2012 |

(Continued)

OTHER PUBLICATIONS

Burgoyne, "Microfluidics to diagnose sleeping sickness", http://blogs.rsc.org/lc/2011/03/23/microfluidics-to-diagnose-sleeping-sickness/, Lab on a Chip, Chemistry World, Mar. 23, 2011, pp. 1-3.

(Continued)

*Primary Examiner* — Timothy Thompson
*Assistant Examiner* — Charles Pizzuto
(74) *Attorney, Agent, or Firm* — Dorsey & Whitney LLP

(57) ABSTRACT

Methods and devices for transporting and/or providing electricity are provided herein. In some embodiments, this includes a flexible conduit and charge carrying microparticles provided therein. In some embodiments the microparticles are charged at a first charging terminal, moved to a new location where there is a charge collecting terminal, where the charge on the microparticle can then be discharged.

21 Claims, 12 Drawing Sheets

(56) References Cited

U.S. PATENT DOCUMENTS

| | | | | |
|---|---|---|---|---|
| 2007/0131543 | A1* | 6/2007 | Cho | C25B 1/06 204/280 |
| 2007/0183934 | A1* | 8/2007 | Diercks | B01L 3/502761 422/400 |
| 2010/0116527 | A1 | 5/2010 | Khosla et al. | |
| 2010/0263917 | A1 | 10/2010 | Heo et al. | |
| 2010/0327236 | A1* | 12/2010 | Enomura | B22F 9/24 252/512 |
| 2011/0042126 | A1* | 2/2011 | Spaid | G06F 3/045 174/250 |
| 2011/0238177 | A1* | 9/2011 | Farco | A61M 1/127 623/11.11 |
| 2012/0067615 | A1* | 3/2012 | Blaiszik | H01B 1/02 174/110 R |
| 2012/0328834 | A1* | 12/2012 | Unger | B01L 3/502707 428/156 |

FOREIGN PATENT DOCUMENTS

| | | | | |
|---|---|---|---|---|
| GB | 1 487 310 | | 9/1977 | |
| GB | 1 487 325 | | 9/1977 | |
| GB | 1487310 | * | 9/1977 | |
| GB | 1487310 | A * | 9/1977 | |
| JP | 05-267396 | | 10/1993 | |
| JP | 07-157788 | A | 6/1995 | |
| JP | 2001-129000 | | 5/2001 | |
| JP | 2005-261867 | | 9/2005 | |
| JP | 2007-173226 | | 7/2007 | |
| WO | WO 01/01025 | A2 | 1/2001 | |
| WO | WO 03089138 | A2 * | 10/2003 | B01L 3/00 |
| WO | WO 2008/047022 | | 4/2008 | |
| WO | WO 2008/130431 | | 10/2008 | |
| WO | WO 2010/023669 | A2 | 3/2010 | |

OTHER PUBLICATIONS

Elastomer (from Wikipedia), http://en.wikipedia.org/wiki/Elastomer; information was available at website: http://en.wikipedia.org/wiki/Elastomer in some form no later than Aug. 31, 2011.

Hermetic seal (from Wikipedia), http://en.wikipedia.org/wiki/Hermetic_seal; information was available at website: http://en.wikipedia.org/wiki/Hermetic_seal in some form no later than Aug. 31, 2011.

International Search Report and Written Opinion received in International Application No. PCT/US2012/027746, dated on May 24, 2012, filed on Mar. 5, 2012.

Kim et al., "Stretchable and Foldable Silicon Integrated Circuits", Science, Apr. 25, 2008, pp. 507-511, vol. 320.

Nanoimprint Lithography (from Wikipedia) http://en.wikipedia.org/wiki/Nanoimprint_lithography; information was available at website: http://en.wikipedia.org/wiki/Nanoimprint_lithography, in some form no later than Aug. 31, 2011.

PatentJP.com, http://www.patentjp.com/07/L/L100226/DA10016.html; information was available at website: http://en.wikipedia.org/wiki/Percolation_threshold, in some form no later than Aug. 31, 2011.

"Percolation threshold", http://en.wikipedia.org/wiki/Percolation_threshold; information was available at website: http://en.wikipedia.org/wiki/Percolation_threshold, in some form no later than Aug. 31, 2011.

"Transformer Oil", http://en.wikipedia.org/wiki/Transformer_oil; information was available at website: http://en.wikipedia.org/wiki/Transformer_oil, in some form no later than Aug. 31, 2011.

"Natural Rubber", http://en.wikipedia.org/wiki/Natural_rubber; information was available at website: http://en.wikipedia.org/wiki/Natural_rubber, in some form no later than Aug. 31, 2011.

http://solutions.3m.com/wps/porta1/3M/en%20US/ElectronicsChemicals/Home/Products/ElectronicLiquids/?WT.mcid=Electronics Redirect&WT.tsrc=Redirect; information was available at website: http://solutions.3m.com/wps/portal/3M/en%20US/ElectronicsChemicals/Home/Products/ElectronicLiquids/?WT.mcid=Electronics Redirect&WT.tsrc=Redirect; in some form no later than Aug. 31, 2011.

"Method of Generating Micro Bubbles," http://staff.aist.go.jp/m.taka/RS_Generation_methods_of_MB.html; Information was available at website: http://staff.aist.go.jp/m.taka/RS_Generation_methods_of_MB.html; in some form no later than Nov. 24, 2010.

Yamada, Mechanism of Material Property Expression of Conductive Composite Material based on Percolation Theory, Nichias Technology Report, No. 333, vol. 5, 2002.

* cited by examiner

FLEXIBLE CIRCUITS

CROSS-REFERENCE TO RELATED APPLICATION

This application is the U.S. national phase entry under 35 U.S.C. §371 of PCT/US2012/027746, filed on Mar. 5, 2012, the entire disclosure of which is hereby incorporated by reference herein.

TECHNICAL FIELD

Some embodiments herein generally relate to flexible electric circuits.

BACKGROUND

There are a variety of approaches for providing flexible circuits. In some situations, elastic CMOSs can be used that include a silicone base pattern on a thermoplastic resin. In other situations, people have used a flexible wire having improved bending strength by applying a patterned conductor on a flexible insulating substrate and forming a thick insulating film at the bending sections. Such flexible arrangements allow for electrical components to be incorporated into devices or more readily incorporated into traditional electronics.

SUMMARY

In some embodiments, a charge-carrying conduit is provided. In some embodiments, the charge-carrying conduit can include at least one channel configured to transport a liquid, at least one flowable medium within the channel, and at least one microparticle suspended within the flowable medium and configured to accept an electrical charge and donate the electrical charge.

In some embodiments, a flow based electrical circuit is provided. In some embodiments, the circuit can include a conduit having at least one channel configured to carry a flowable medium. In some embodiments, the circuit can further include at least one charge-collecting terminal and at least one charging terminal.

In some embodiments, a method of transmitting electricity is provided. In some embodiments, the method can include supplying an electrical charge to at least one microparticle at a first location. In some embodiments, the method can include moving the at least one microparticle along a channel to a second location and discharging the at least one microparticle at the second location, thereby transmitting electricity.

In some embodiments, a method of making a flexible conduit is provided. In some embodiments, the method can include providing a flexible layer on a substrate, patterning at least one channel on the layer, and sealing the at least one channel. In some embodiments, the method can further include providing a flowable medium to the channel and suspending a microparticle within the flowable medium.

In some embodiments, a charge-carrying conduit is provided. In some embodiments, the charge carrying conduit can include at least one channel configured to transport a liquid, wherein a surface of the at least one channel includes a material that is an electrical insulator, and a sealing film positioned over the channel and configured to provide a fluid tight seal, so as to retain a fluid within the channel.

In some embodiments, a method of transmitting energy is provided. In some embodiments, the method can include providing at least one charge-collecting terminal, providing at least one charging terminal, and providing a conduit having at least one channel configured to carry a flowable medium. In some embodiments, the conduit connects the at least one charging terminal to the at least one charge-collecting terminal. In some embodiments, the method can include providing at least one microparticle configured to accept an electrical charge and configured to donate the electrical charge and charging the at least one microparticle by the at least one charging terminal to form a charged microparticle. In some embodiments, the microparticle can be pumped from the charging terminal to the charge-collecting terminal, and the charged microparticle can be discharged at the charge-collecting terminal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
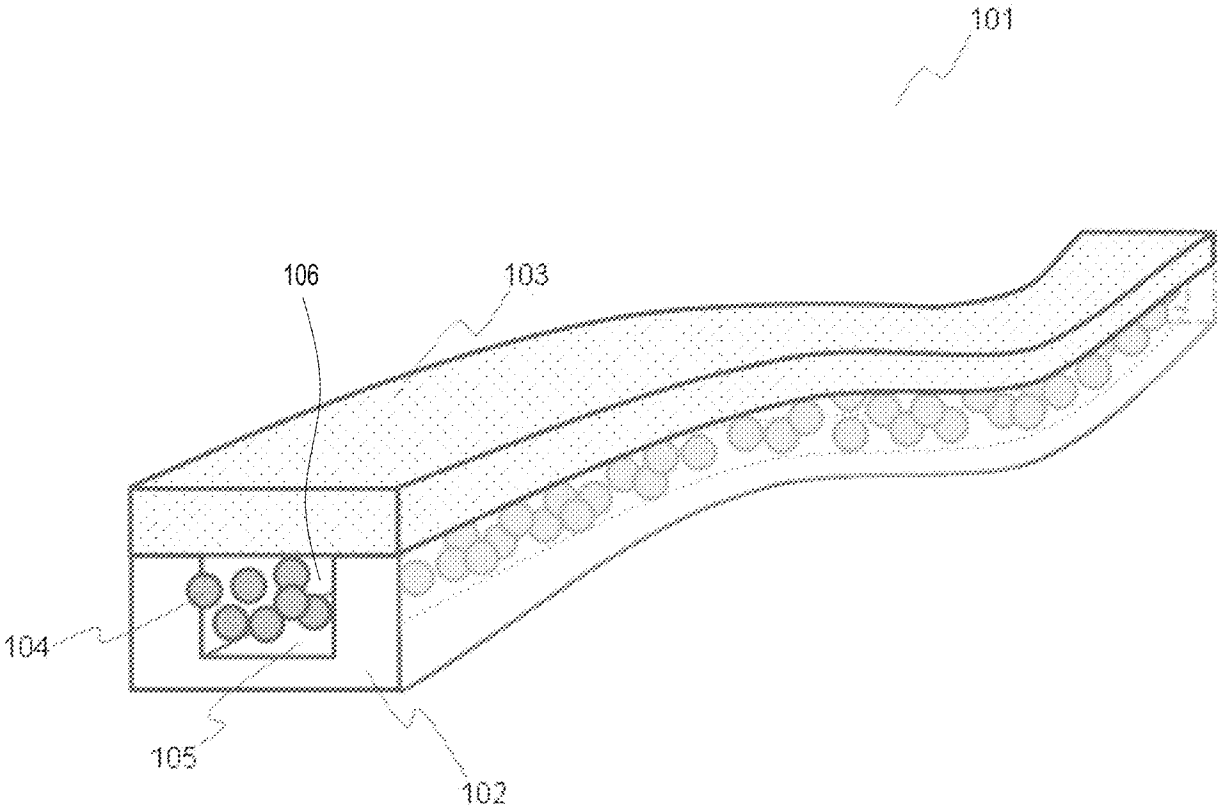
FIG. 1 is a drawing depicting some embodiments of a charge-carrying conduit.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments can be utilized, and other changes can be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

While there have been a variety of attempts at providing flexible conducting structures, at present, there are no known attempts at establishing conductivity by using conductive microparticles as carriers in an elastic circuit. Some embodiments provided herein provide and/or allow for manufacturing various circuits and/or structures that can include a microparticle configured to accept an electrical charge and donate an electrical charge. In some embodiments, provided herein, are methods and/or devices that allow for transmission of energy. In some embodiments, the above can be achieved by or through the use of a microparticle in a charge-carrying conduit. In some embodiments, the charge-carrying conduit can serve to transport the microparticle. In some embodiments, the microparticle can be transported from a charging station to a discharging station, where the charge in the microparticle can be provided to drive an electrical device, create an electrical potential, and/or provide energy for some other electrical manipulations.

In some embodiments, a method of transmitting energy is provided. The method can include providing at least one charge-collecting terminal, providing at least one charging terminal, providing a conduit including at least one channel configured to carry a flowable medium, wherein the conduit connects the at least one charging terminal to the at least one charge-collecting terminal, providing at least one microparticle configured to accept an electrical charge and configured to donate the electrical charge, charging the at least one microparticle by the at least one charging terminal to form a charged microparticle, moving (e.g., pumping) the microparticle from the charging terminal to the charge-collecting terminal, and discharging the charged microparticle at the charge-collecting terminal. In some embodiments, the microparticles are the only items in the conduit. In some embodiments, the microparticles are suspended or contained in a flowable medium. In some embodiments, the flowable medium can have some insulating properties. In some embodiments, the flowable medium can include a dispersion medium, to help suspend the microparticles, and/or a conductive medium. These, and additional aspects are discussed in more detail below.

Charge Carrying Conduits

In some embodiments, a charge-carrying conduit is provided. The charge-carrying conduit can include at least one channel configured to transport a fluid. In some embodiments, a surface of the at least one channel includes a material that is an electrical insulator, and a sealing film is located over the channel and configured to provide a fluid tight seal, so as to retain a fluid within the channel. In some embodiments, one or more of the walls can be of a conducting material, and the wall is electrically isolated from the rest of the device (e.g., by an insulator or by space).

FIG. 1 is a drawing that depicts some embodiments of a charge-carrying conduit 101 that can include at least one channel 106 formed by a wall 102. In some embodiments, the wall is flexible and/or stretchable. In some embodiments, the wall can be and/or include an elastomer material. In some embodiments, at least a portion of the at least one channel 106 can be at least partially closed with a sealing film 103. As shown in FIG. 1, in some embodiments, the charge-carrying conduit 101 can include at least one microparticle 104. In some embodiments, the charge-carrying conduit 101 can include at least one flowable medium 105. In some embodiments, the at least one microparticle 104 and/or at least one flowable medium 105 can flow and/or be pumped and/or be transmitted through the charge-carrying conduit 101.

In some embodiments, the charge-carrying conduit 101 has at least one channel 106 configured to transport a liquid. In some embodiments, the at least one channel has at least one elastomer wall 102. In some embodiments, the channel can have a circular diameter. In some embodiments, the cross-section of the channel can be square and/or rectangular. In some embodiments, any shape can be used.

In some embodiments, the at least one wall includes an elastomer material. In some embodiments, the elastomer material can include a heat resistant and/or elastic material. In some embodiments, only a subset of the walls and/or surfaces of the channel are flexible.

In some embodiments, the elastomer material can include a thermo-setting resin. For example, silicone rubber can be a suitable thermosetting-resin type elastomer for the material of the channel wall 102. In some embodiments, silicone rubber can be highly heat resistant and elastic.

In some embodiments, the elastomer material can include silicon rubber (Q), a natural rubber, an acrylic rubber (including polyacrylic rubber (ACM, ABM)), a nitrile rubber, an isoprene rubber (IR), a polyisobutylene rubber (IIR), an urethane rubber, or a fluoro-rubber (FKM) (including fluorosilicone rubber (FVMQ)), polyisoprene rubber, butadiene rubber (BR), polybutadiene rubber, chloroprene rubber (CR), polychloroprene, neoprene, baypren (R), butyl rubber, styrene-butadiene rubber (SBR), ethylene propylene rubber (EPM), ethylene propylene diene rubber (EPDM), epichlorohydrin rubber (ECO), fluoroelastomers (FKM and FEPM), chlorosulfonated polyethylene (CSM), Ethylene-vinyl acetate (EVA), or any combination thereof.

In some embodiments, the sealing film 103 seals the channel 106 so as to contain the flowable medium 105 and allow it to be pumped along a length of the conduit. In some embodiments, the sealing film can include an elastomer material. In some embodiments, the sealing film 103 and the at least one elastomer wall 102 are made of the same material.

In some embodiments, the sealing film 103 forms a hermetic seal with the walls of the channel 102. In some embodiments, the hermetic seal can cause the conduit to be airtight. In some embodiments, the charge-carrying conduit can be impervious to air or gas where the sealing film 103 is hermetically sealed to the walls of the channel 102. In some embodiments, there is no restriction as to the type of seal formed by the sealing film 103. In some embodiments, the sealing film directly contacts and seals the channel. In some embodiments, there can be additional intervening structures. In some embodiments, multi-layered sealing films can be employed (for example as described in "Multi-layer hermetically sealable film", U.S. Pat. No. 6,794,021 B2, Sep. 21, 2004).

In some embodiments, the charge-carrying conduit 101 includes at least one microparticle 104. In some embodiments, the at least one microparticle 104 can be configured to accept an electrical charge and configured to donate the electrical charge. In some embodiments, the at least one microparticle 104 can be configured to carry a charge. In some embodiments, the at least one microparticle can be metal microparticles, microparticles in which a metal is deposited on the surface of a bead formed of ceramic or the like, carbon polymers, and/or conductive polymers. In some embodiments, the microparticles can be made of any material that can hold a charge and release it. In some embodiments, the microparticle 104 can include an electrically conductive material. For example, in some embodiments, the at least one microparticle 104 can include a metal. In some embodiments, the at least one microparticle 104 can include a liquid metal, e.g., mercury. In some embodiments, the at least one microparticle can include carbon, grapheme, graphite, fullerene, carbon nanotubes (CNT), carbon black (CB), carbon fiber, black lead or a combination thereof.

In some embodiments, the at least one microparticle 104 can include a conductive polymer. In some embodiments, the conductive polymer can be an intrinsically conducting polymer. For example, the conductive polymer can include polyacetylene, polypyrrole, and polyaniline or one of their copolymers. In some embodiments, the conductive polymer can include poly(p-phenylene vinylene) (PPV) or its soluble derivatives, or poly(3-alkylthiophenes).

In some embodiments, the microparticle 104 can include a ceramic core and a metal shell. In some embodiments, the ceramic core can include a ceramic material. In some embodiments, the ceramic material can have a crystalline, partly crystalline, or amorphous structure. The ceramic material can include, for example, clay, quartz, feldspar, stoneware, porcelain, kaolin, or bone china. The ceramic material can include, for example oxides, e.g., alumina, beryllia, ceria, zirconia; nonoxides, e.g., carbide, boride, nitride, silicide; or composite materials, e.g., particulate reinforced, fiber reinforced, combinations of oxides and nonoxides. In some embodiments, there is no restriction as to the type of materials that the ceramic core can be made from.

In some embodiments, the charge-carrying conduit includes a flowable medium 105. In some embodiments, the flowable medium 105 can include an electrically insulating material. For example, in some embodiments, the flowable medium 105 can include a silicone oil, a mineral oil, an alkyl benzene, a polybutylene, an alkylnaphthalene, an alkyldiphenylalkane, a fluorinated inert fluid, toluene or any combination thereof. In some embodiments, the flowable medium includes a silicone oil or the like. In some embodiments, the flowable medium can include a gas. In some embodiments, it can be chemically stable and electrically insulating, for example, noble gases (He, Ne, Ar, Kr, Xr,), $H_2$, $N_2$, or the mixture of such gases. In some embodiments, any percent of microparticles to flowable medium can be used, e.g., 0.01, 0.1, 1, 5, 10, 15, 20, 30, 40, 50, 60, 70, 80, 85, 90, 95, 98, 99, 99.9, 99.99%, or greater of the combined microparticle and flowable medium can be microparticles, with the rest being the flowable medium (by wt %), including any range between any two of the preceding values and any range above any one of the preceding values. In some embodiments, the flowable medium can include some amount of an insulating material, e.g., 0.01, 0.1, 1, 5, 10, 15, 20, 30, 40, 50, 60, 70, 80, 85, 90, 95, 98, 99, 99.9, 99.99%, or greater of the flowable material can be an insulating material, including any range between any two of the preceding values and any range above any one of the preceding values. In some embodiments, the flowable medium can include some amount of a conducting medium and/or material, e.g., 0.01, 0.1, 1, 5, 10, 15, 20, 30, 40, 50, 60, 70, 80, 85, 90, 95, 98, 99, 99.9, 99.99%, or greater of the flowable material can be a conducting medium and/or material (described in more detail below), including any range between any two of the preceding values and any range above any one of the preceding values.

In some embodiments, the flowable medium 105 suspends and/or at least partially surrounds the microparticle 104. In some embodiments, the microparticle 104 is dispersed in the flowable medium 105. In some embodiments, the microparticle 104 is suspended within the flowable medium 105. In some embodiments, the flowable medium 105 provides insulation to electrically isolate the microparticles 104 from the walls of the channel and/or outside and/or other microparticles.

In some embodiments, the charge-carrying conduit 101 does not include a flowable medium 105.

In some embodiments, the at least one microparticle 104 is present at a concentration that allows for the percolation threshold for the flowable medium 105 to be reached and/or exceeded. In some embodiments, a percolation threshold refers to simplified lattice model of random systems or networks (graphs), and the nature of the connectivity in them. The percolation threshold is a value of the occupation probability p, or more generally a critical surface for a group of parameters p1, p2, such that infinite connectivity (percolation) first occurs. Percolation thresholds can depend on the concentration (p) of the conductive medium. When p is equal to the percolation threshold ($p_c$), the number of clusters ($n_s$) is proportional to $s^{-\tau}$, where s is the size of the clusters and $\tau$ is index number ($\tau$=2.2 in three dimensional model). $N_s$ can be described as:

$$\mathrm{LOG}(n_s)=-\tau*\mathrm{LOG}(s)+C'$$

where C' is constant.

In some embodiments, to achieve efficient electron transmission, the microparticles 104 and flowable medium 105 are set or adjusted to achieve a percolation threshold. The percolation threshold can depend on at least one of the properties of the flowable medium 105. The properties can include, but are not limited to size, shape, distribution, thickness of the network, and orientation. One of skill in the art, given the present disclosure, will appreciate how to determine and adjust the required types and levels of microparticles, flowable medium, and other ingredients.

Figure 7A:
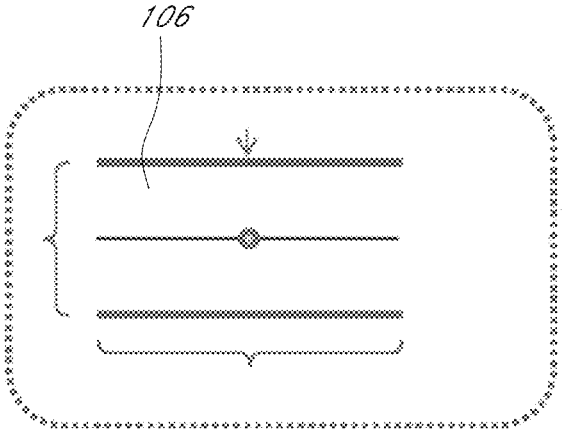
FIG. 7A is a drawing depicting some embodiments of a channel.
Figure 7B:
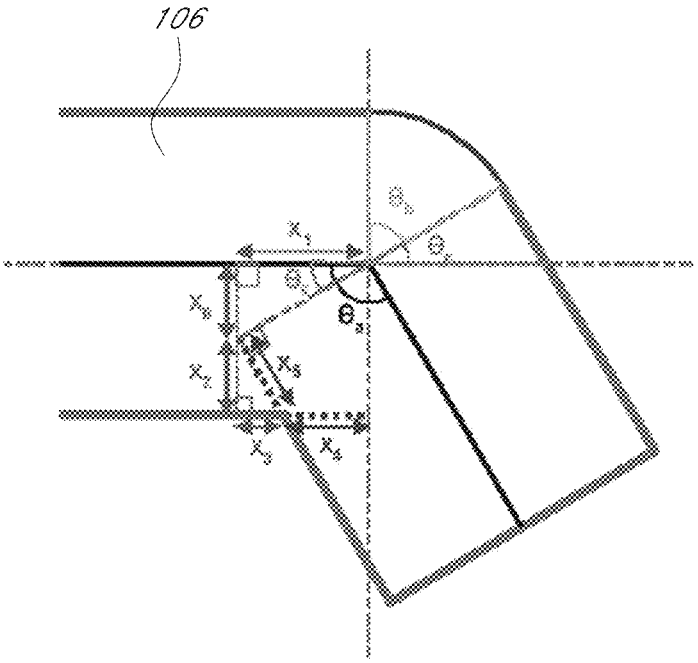
FIG. 7B is a drawing depicting some embodiments of a flexed channel.
Figure 7C:
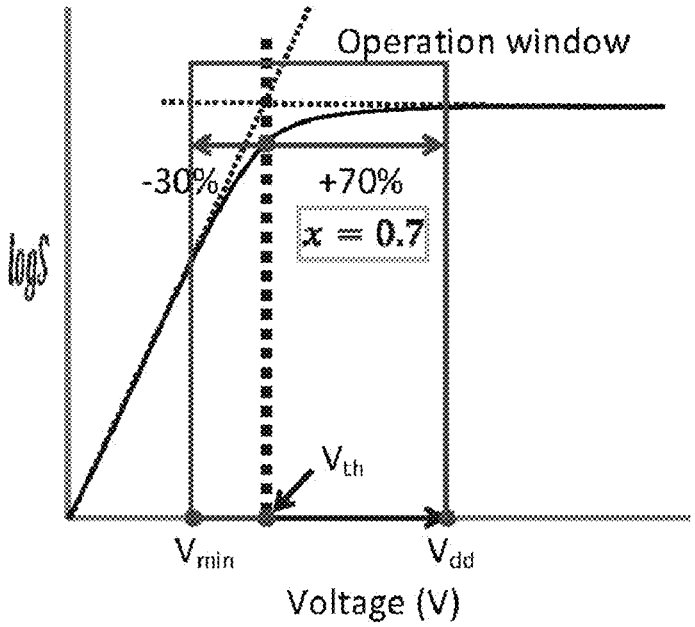
FIG. 7C is a graph depicting some embodiments of an operational window of voltages.

In some embodiments, the at least one microparticle 104 includes graphene and is present at about 2.5 wt % to the flowable medium, e.g., 2.5, 3, 4, 5, 6, 7, 8, 10, 15, 20, 30, 40, 50, 60, 70, 80, 90, 95, 99, or less than 100 wt % of the flowable medium, including any range defined between any two of these values and any range defined above any one of these values. In some embodiments, one can include an amount of microparticles such that one avoids 1) producing a system that is conductive everywhere (for example, inducing leakage current and inefficient electrical transport), and/or 2) degrading flow dynamics. Thus, in some embodiments, these aspects can be used to define an upper bounds on the amount of the microparticle used. In some embodiments the amount of microparticle used is determined by considering the relationship between good conductivity at the charging and discharging terminals and leakage current and insufficient mobility. In some embodiments, the amount of microparticle used can be sufficient so as to allow the resulting voltage to fall within an operational window that is above a $V_{min}$ value. While the resistivity can increase dramatically at the percolation threshold, at a subthreshold region (see FIG. 7C), the resistivity can still be adequately low for some uses. Thus, in some embodiments, the percent of microparticle used can be under the percolation threshold. FIG. 7C displays an example of an operation window. While not limiting, it is noted that these values can be determined experimentally and/or in light of the following guiding concepts:

$$R = \rho\frac{l}{A}$$

where A is the cross sectional area of the conduit and l is the length of the conduit and $$S = \frac{1}{R} = \frac{A}{\rho l}$$

and for a percolation threshold (where $\rho=\rho_c$)

$$S = \frac{1}{R} = \frac{A}{\rho_c l}$$

Further, if the operation window is set as follows:

$$V_{min}=V_{th}-(1-x)V_{th},$$

then the percolation threshold minimum ($\rho_{c(min)}$) is:

$$(\rho_{c(min)})=A/(S(V_{th}-(1-x)V_{th})*l)$$

where A is the cross-sectional area of the channel, l is the length of the channel, S is conductivity, and x is the fraction of the operation window. $V_{dd}$(in FIG. 7C) can be defined as follows:

$$V_{dd}=V_{max}=V_{th}+xV_{th}$$

and $V_{min}$ can be defined as:

$$V_{min}=V_{th}-(1-x)V_{th}$$

In some embodiments, a minimal amount of microparticle can be based upon achieving the minimal voltage (for example by using $\rho_{c(min)})=A/(S(V_{th}-(1-x)V_{th})*l)$. In some embodiments, the position of the operation window can be changed by changing the fraction "x". In some embodiments, x can be, for example, 0.1, 0.2, 0.3, 0.4, 0.5, 0.6, 0.7, 0.8, 0.9, or 1.

In some embodiments, the at least one microparticle 104 includes carbon nanotubes and is present at about 2.5 wt % to the flowable medium 105, e.g., 2.4, 2.5, 2.6, 2.7, 3, 4, 5, 10, or 15%, including any range between any two of the preceding values and any range above any one of the preceding values. In some embodiments, the at least one microparticle 104 includes black lead and is present at about 31.17 wt % to the flowable medium 105, e.g., 30, 31, 31.17, 32, 33, 35, 40, 45, 50 or 60%, including any range between any two of the preceding values and any range above any one of the preceding values.

In some embodiments, the conduit can also include at least one temperature control element. In some embodiments, the at least one temperature control element can be used to increase or decrease the temperature of the flowable medium and/or the microparticles in at least some portion of the conduit. In some embodiments, the temperature of the flowable medium can be manipulated to change the flow rate and/or viscosity of the flowable medium. For example, in some embodiments, the temperature control element can be used to decrease the viscosity of the flowable medium and increase the flow rate of the flowable medium. In some embodiments, the temperature control element can be used to increase the viscosity of the flowable medium and decrease the flow rate of the flowable medium.

In some embodiments, the temperature control element can be used to change the conductivity of the flowable medium and/or the microparticles. In some embodiments, electrical resistivity of metals increases with temperature, while the resistivity of intrinsic semiconductors decreases with increasing temperature. At high temperatures, the resistance of a metal can increase linearly with temperature. As the temperature of a metal is reduced, the temperature dependence of resistivity follows a power law function of temperature. As the temperature of the metal is sufficiently reduced (so as to 'freeze' all the phonons), the resistivity usually reaches a constant value, known as the residual resistivity. This value depends on the type of metal and on its purity and thermal history. The value of the residual resistivity of a metal is decided by its impurity concentration.

Electrical Circuits

Figure 2:
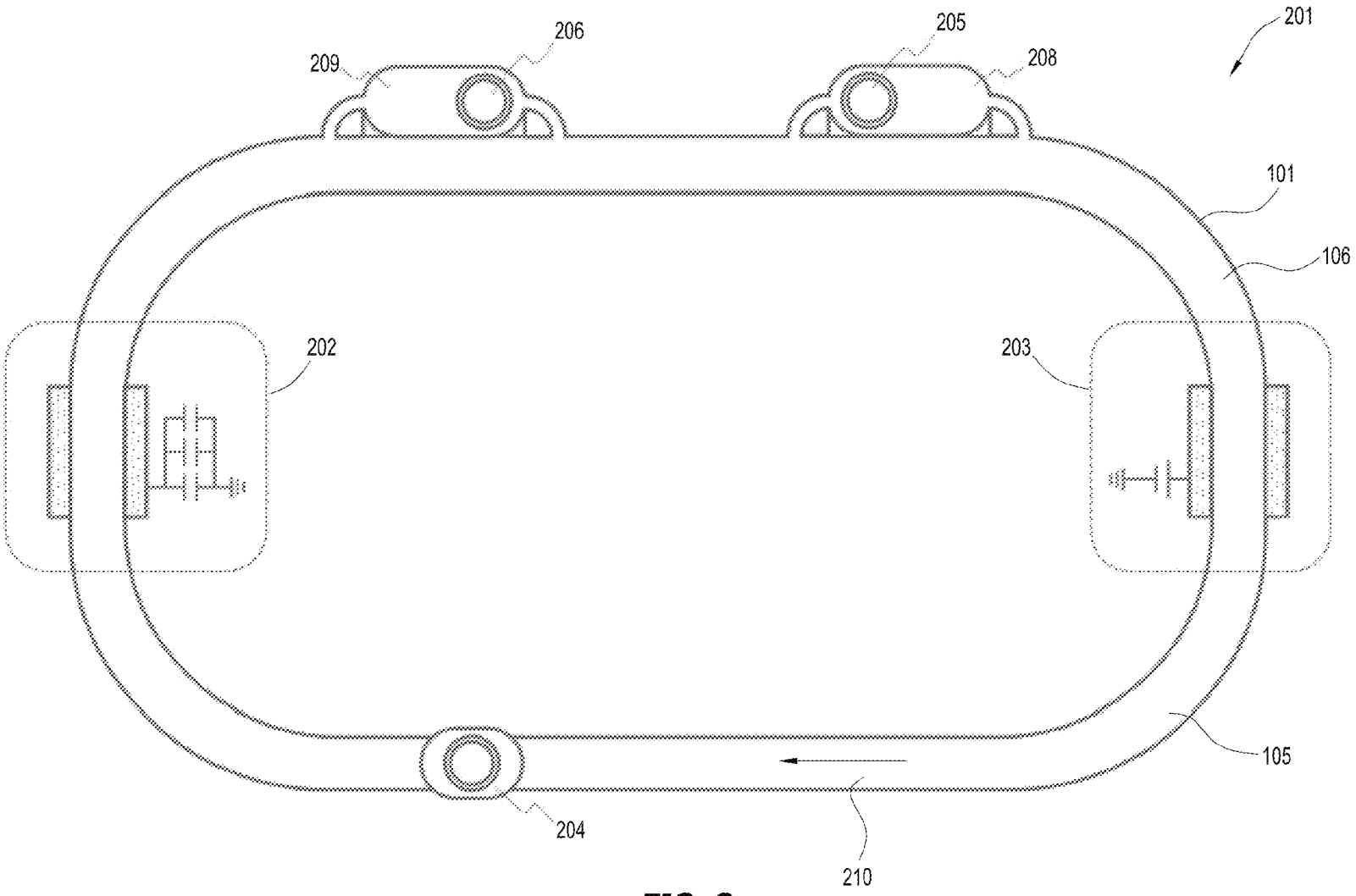
FIG. 2 is a drawing depicting some embodiments of a flow based electrical circuit.

FIG. 2 is a drawing that depicts some embodiments of a flow based electrical circuit 201. In some embodiments, the circuit 201 can include a charge-carrying conduit 101 having at least one channel 106 configured to carry a flowable medium 105, as described herein. As shown in FIG. 2, in some embodiments, the circuit 201 can include at least one charge collecting terminal 202 and at least one charging terminal 203. In some embodiments, the circuit 201 can also include at least one pump 204 configured to move the flowable medium along a conduction path 210 between the terminals 202, 203. In some embodiments, the circuit can also include an inlet 205 and/or an outlet 206. In some embodiments, the inlet 205 and/or outlet 206 can include a reservoir 208, 209.

In some embodiments, the at least one pump 204 is configured to move the flowable medium 105 along the channel 106. In some embodiments, the pump 204 can include, but is not limited to, a centrifugal pump, ventricular assist device (VAD) pump, diaphragm pump, gear pump or peristaltic pump.

In some embodiments, the flowable medium 105 moves at a flow rate corresponding to a kinetic viscosity of the flowable medium 105. In some embodiments, the kinetic viscosity of a flowable medium 105 can change depending on the material composition, density, temperature, and/or pressure. For example, the lowest kinetic viscosity of silicone at 25° C. can be 0.65 $mm^2/s$ and the highest kinetic viscosity can be 500,000 $mm^2/s$. In some embodiments, the at least one microparticle 104 moves at a flow rate of about the kinetic viscosity of the flowable medium 105 or less. For example, in some embodiments, the flow rate of the microparticles 104 is about 0.65 $mm^2/s$ or more. In some embodiments, the flow rate of the microparticles 104 is about 500,000 $mm^2/s$ or less. In some embodiments, the network includes microparticles, flowable medium, and terminals, which are arranged to achieve percolation conduction. In some embodiments, the percolation threshold depends on the microparticle's 1) size, 2) shape, and 3) distribution, and can also depend on the 4) thickness of the network and 5) orientation. In some embodiments, the flow rates are set beneath the kinetic viscosity of the flowable medium. In some embodiments, the kinetic viscosity is from about 0.001 $mm^2/s$ to about 10,000,000 $mm^2/s$, e.g., 0.001, 0.01, 0.1, 1, 10, 100, 1,000, 10,000, 100,000, 1,000,000, or 10,000,000 $mm^2/s$, including any range above any one of the preceding values and any range between any two of the preceding values. In some embodiments the lowest kinetic viscosity is 0.65 $mm^2/s$ and the highest 500,000 $mm^2/s$, e.g., for silicone at 25° C. In some embodiments, the flow rate is from 0.001 mm/s to 10,000 mm/s, e.g., 0.001, 0.01, 0.1, 1, 10, 100, 1000, or 10,000 mm/s, including any range defined between any two of the preceding values and any range defined as being above any one of the preceding values.

FIG. 3A to FIG. 5B are drawings that depict some embodiments of terminals 202 and 203. While these figures and embodiments are discussed below generally in terms of a "charge collecting" terminal or a "charging" terminal, one of skill in the art will understand that the structures are swappable if desired. Thus, in some embodiments, any of the charge collecting terminals can be used as a charging terminal and/or any of the charging terminals can be used as a charge-collecting terminal, when appropriately wired. Thus, for example, in some embodiments, a circuit can include two of the depicted "charge collecting" terminals (one configured for charging and one configured for charge collecting) or two of the depicted "charging" terminals (one configured for charging and one configured for charge collecting). In some embodiments, the battery and/or DC power supply can be replaced with a capacitor, battery, or a device that can use the electrical power. In some embodiments, the capacitor, battery, or a device that can use the electrical power can be replaced with a battery and/or DC power supply.

Figure 3A:
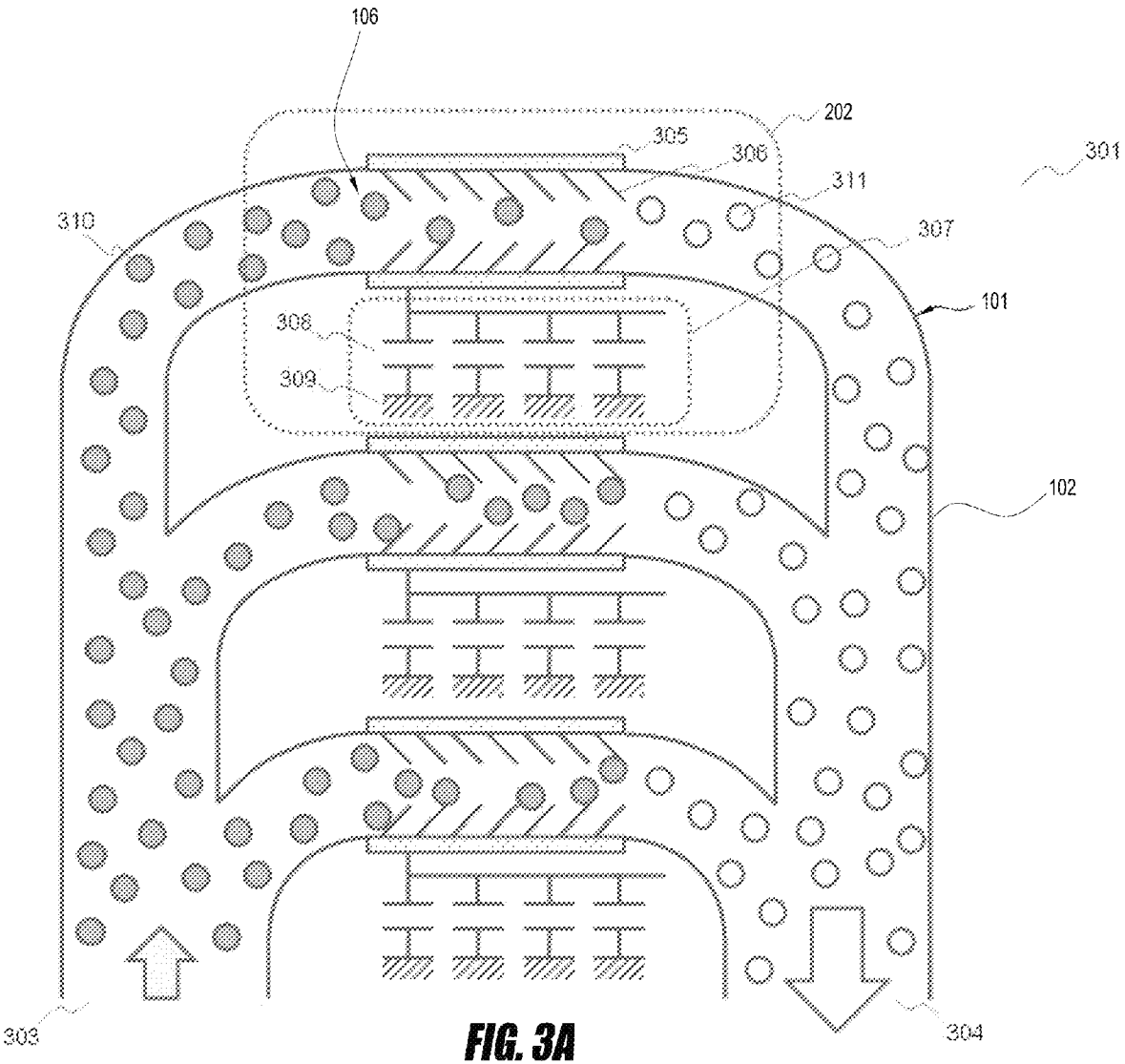
FIG. 3A is a drawing depicting some embodiments of a charge collecting and/or a charging terminal.

FIG. 3A is a drawing that depicts some embodiments of a charge-collecting terminal 202. In some embodiments, the circuit 301 can include more than one charge-collecting terminal 202. As shown in FIG. 3A, in some embodiments, the charge collecting terminals can be in parallel. In some embodiments, the charge collecting terminals can be in series. In some embodiments, the charge collecting terminals can be in parallel. While there is no limit on the number of charge collecting terminals that can be used, in some embodiments, 1, 2, 3, 4, 5, 6, 7, 8, 9, 10, 15, 20, 25, 30, 40, 50, or 100 charge collecting terminals can be used, including any range above any one of the preceding values and any range between any two of the preceding values.

In some embodiments, the charge collecting terminal 202 is configured to collect a charge from charged microparticles 310. As shown in FIG. 3A, in some embodiments, the charge collecting terminal 202 can include at least one electrical contact 305, such as a metal plate and/or substrate, and/or at least one metal brush 306, and/or at least one storage area, such as a charger 307 (depicted here as a set of capacitors). In some embodiments, the charge is fed to a battery. In some embodiments, the charge is fed to a device to use the charge directly. In some embodiments, the metal brush 306 collects the charges of charged microparticles 310, which turn into uncharged microparticles 311 that are uncharged and/or have a relatively small charge. In some embodiments, only a portion of the particles is discharged as they pass through the charge-collecting terminal. In some embodiments, subsequently placed charge collecting terminals can be present to collect at least some of any remaining charge or charged microparticles. In some embodiments, such as when the capacitors are fully charged, or the charge collecting terminal is not connected to a device or storage system, the charged microparticles can pass through the charge collecting terminal without taking much, if any, of the charge from the microparticles.

In some embodiments, the at least one electrical contact 305 can be part of the channel wall 102. In some embodiments, the at least one electrical contact 305 can be adjacent to the channel 106.

In some embodiments, as the contact surface of the electrical contact 305 increases, the collision probability of the charged microparticles 310 increases. In some embodiments, the electrical contact can cover some amount of the surface of the wall and/or the outer boundary of the channel, e.g., 0.1, 1, 5, 10, 15, 20, 25, 30, 35, 40, 50, 60, 70, 80, 90, 95, 98 or 100% (including any range between any two of the preceding values). In some embodiments, the electrical contact is not present and/or not exposed to the interior of the channel. In some embodiments, the brush 306 can be a single brush. In some embodiments, there can be multiple brushes in series (e.g., down the length of the channel) and/or in parallel (e.g., around and/or across the perimeter of the channel. In some embodiments, the shape of the electrical contact 305 can increase the contact surface and thus increase the collision probability of the microparticles 310. As a result, charges can be collected efficiently.

Figure 3B:
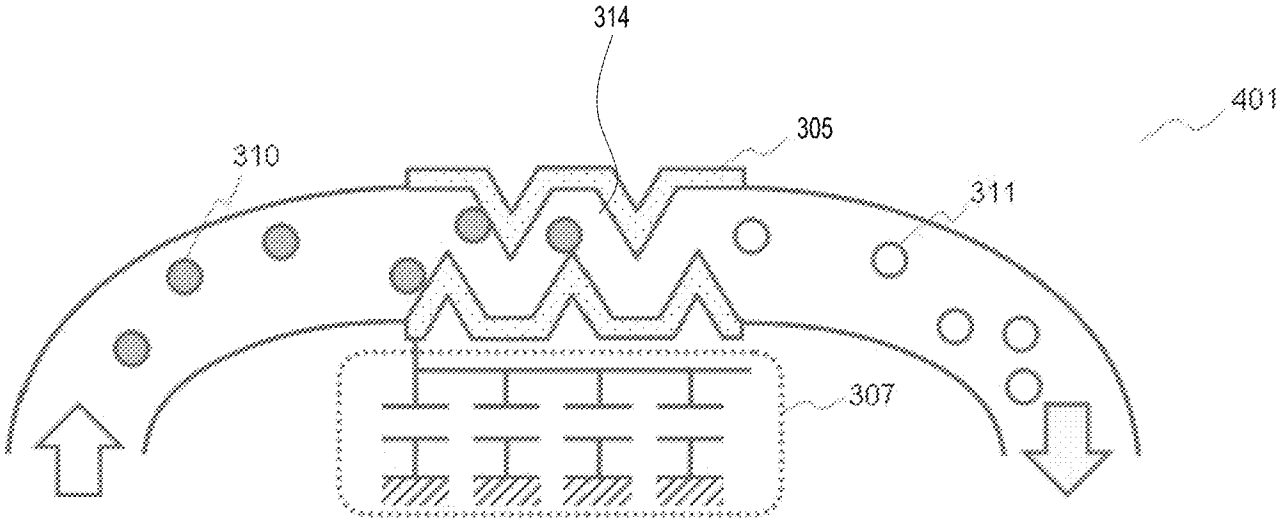
FIG. 3B is a drawing depicting some embodiments of a charge collecting and/or a charging terminal.

FIG. 3B illustrates some embodiments of a circuit 401 with another charge collecting terminal that includes an electrical contact 305. As illustrated in FIG. 3B, by providing a zig-zag surface 314, the contact rate of the microparticles 310 and the electrical contact 305 can increase due to the linear movement of the microparticles 310. In some embodiments, the at least one electrical contact 305 can have a zig-zag surface 314. In some embodiments, there is more than one electrical contact, e.g., 2, 3, 4, 5, 6, or more electrical contacts. In some embodiments, each plate can be zig-zag shaped and/or shaped in a way such that momentum of a microparticle is likely to cause proximity and/or contact between the microparticle and the surface of the electrical contact.

Referring again to FIG. 3A, in some embodiments, the at least one metal brush 306 is configured to collect an electrical charge from the at least one microparticle 310. In some embodiments, the at least one metal brush 306 can be fin shaped. In some embodiments, the at least one metal brush 306 can be shunted to an outer part of the electrical contact 305. In some embodiments, one or more of the brushes can be slanted following the direction of the flow, so as to reduce microparticle blocking. In some embodiments, the number of brushes is adequate to collect the desired amount of charge from the microparticles. In some embodiments, there are 1, 10, 50, 100, 1000, 10,000, 100,000, 1,000,000, 10,000,000 or more brushes, including any range defined between any two of the preceding values and any range above one of the preceding values.

In some embodiments, the at least one charge collecting terminal 202 can include at least one (or "a first") capacitor 308 in electrical communication with the electrical contact 305 and connected in series therewith to a ground 309. In some embodiments, the charge-collecting terminal 202 includes a second and/or additional capacitors. In some embodiments the first capacitor and the second capacitor are connected in series.

The components of the charge-collecting terminal 202 are not limited to the capacitors. For example, each capacitor can be connected to a selection transistor, a bit line, a plate line, and/or a word line to more actively control the charging. In some embodiments, the circuit 301 can also include at least one of a transistor, a bit line, a plate line, and/or a word line. As noted above, in some embodiments, the charge-collecting terminal can be connected to an electrically driven apparatus.

In some embodiments, charged microparticles 310 enter the charge-collecting terminal 202 through a terminal entrance 303 of the terminal 301 and exit through a terminal exit 304. In some embodiments, the charged microparticles 310 can enter the charge-collecting terminal 202 and contact the metal brush 306. The metal brush 306 and the electrical contact 305 can have the same electric potential. When the electrical contact 305 (and/or the metal brush 306) has a potential lower than the charged microparticles, electrons are transmitted from the charged microparticles to the electrical contact 305 (optionally via the metal brush 306), and the charges can be stored in the capacitors 308 (or elsewhere or used) in the charger 307. In some embodiments, the charged microparticles can continue to donate electrons until their potential equals that of the electrical contact 305. In some embodiments, by the time the microparticles flow out of the charge-collecting terminal 202 through the terminal exit 304, the microparticles can be uncharged microparticles 311 that are completely uncharged or have a relatively small charge. In some embodiments, where there is a single terminal, the terminal exit can be immediately adjacent to the end of the terminal.

Figure 5A:
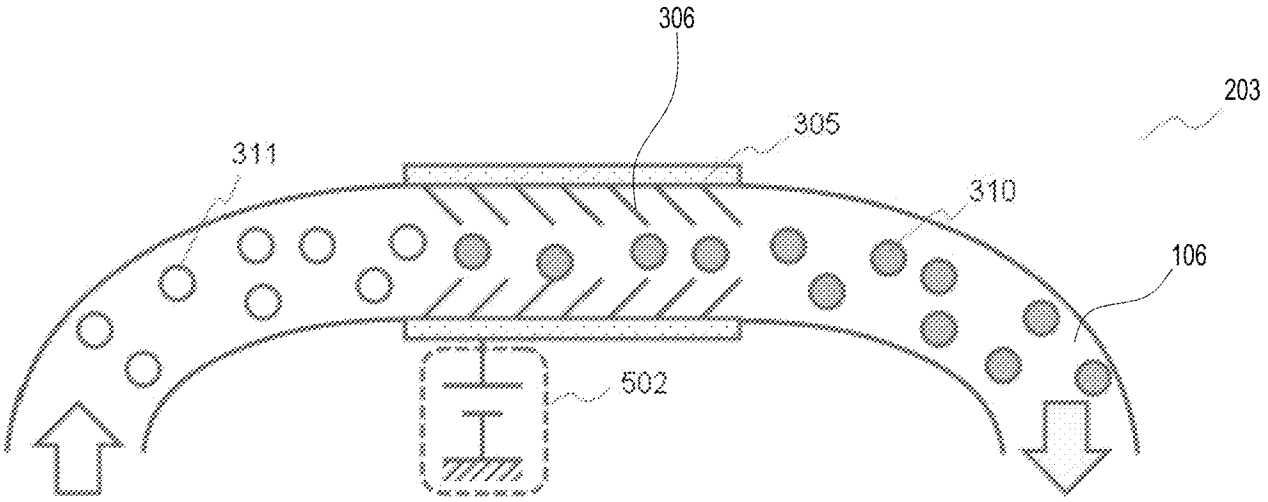
FIG. 5A is a drawing depicting some embodiments of a charge collecting and/or a charging terminal.
Figure 5B:
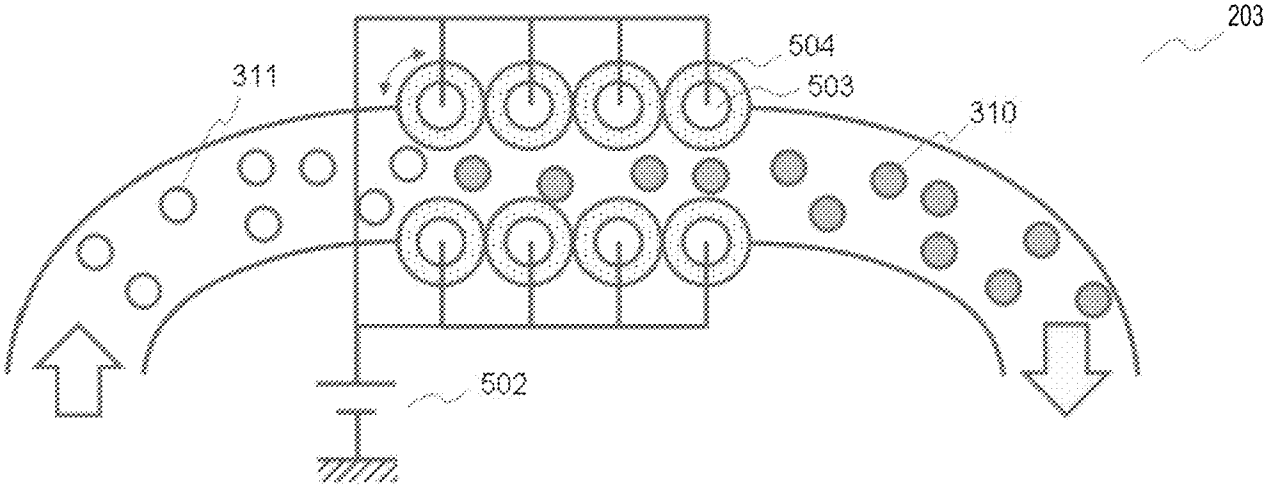
FIG. 5B is a drawing depicting some embodiments of a charge collecting and/or a charging terminal.

FIGS. 5A and 5B are drawings that depict some embodiments of a charging terminal 203. In some embodiments, the uncharged microparticles 311 are charged by at least one charging terminal 203. In some embodiments, the charging terminal 203 can include some of the same components as the charge-collecting terminal, for example, the charging terminal 203 can include, but is not limited to, an electrical contact 305 which can be connected to and/or include a metal brush 306. In some embodiments, the charging terminal 203 can include an electrical contact that is different from an electrical contact of the charge-collecting terminal 202. In some embodiments, the charging terminal can also include a DC power supply 502. In some embodiments, the metal brush 306 of the charging terminal 203 has the same electric potential as the power supply 502. In some embodiments, when an uncharged microparticle 311 contacts the metal brush 306, it is charged to an electric potential that is the same as that of the DC power supply 502. As noted above, in some embodiments, microparticles 310 charged by the charging terminal 203 are transported through the channel 106.

FIG. 5B illustrates some embodiments of a charging terminal 203 including a series of charging elements. In some embodiments, the charging elements (e.g., rollers) include a metal core 503 and/or a metal surface 504. In some embodiments, the charging terminal can include one or more rollers, so as to allow contact with the microparticle, while still allowing the microparticle to continue to flow through the channel. In some embodiments, this can be used for gathering charge as well.

In some embodiments, the at least one charging terminal 203 is in electrical contact with a power supply and/or battery 502.

In some embodiments, the configuration of the terminals satisfies a percolation conduction threshold. In some embodiments, the microparticles are transferred through the conduit to transmit and receive energy to and from corresponding terminals. In some embodiments, the flowable medium serves to set a desired resistivity when charges are transmitted between the microparticles and an electrical contact at each of the terminals.

When electricity is conducted by the charged microparticles and the electrical contact (e.g., brush, roller, and/or metal plate) contacting one another, as described above, the conductivity can be influenced by the flow rate of the charged microparticles, causing an increase in resistance and power transmission loss due to reduced efficiency. In some embodiments, to reduce the resistance between the charged microparticles and the electrical contact and to reduce the power transmission loss, a conductive medium, for example, graphene, graphite, carbon black, black lead, carbon fiber, carbon nanotubes, etc., or a mixture thereof, is mixed with the flowable medium to set the resistance of the flowable medium to a desired value, and electricity is conducted via the charged microparticles, the conductive medium, and the terminals.

Figure 4:
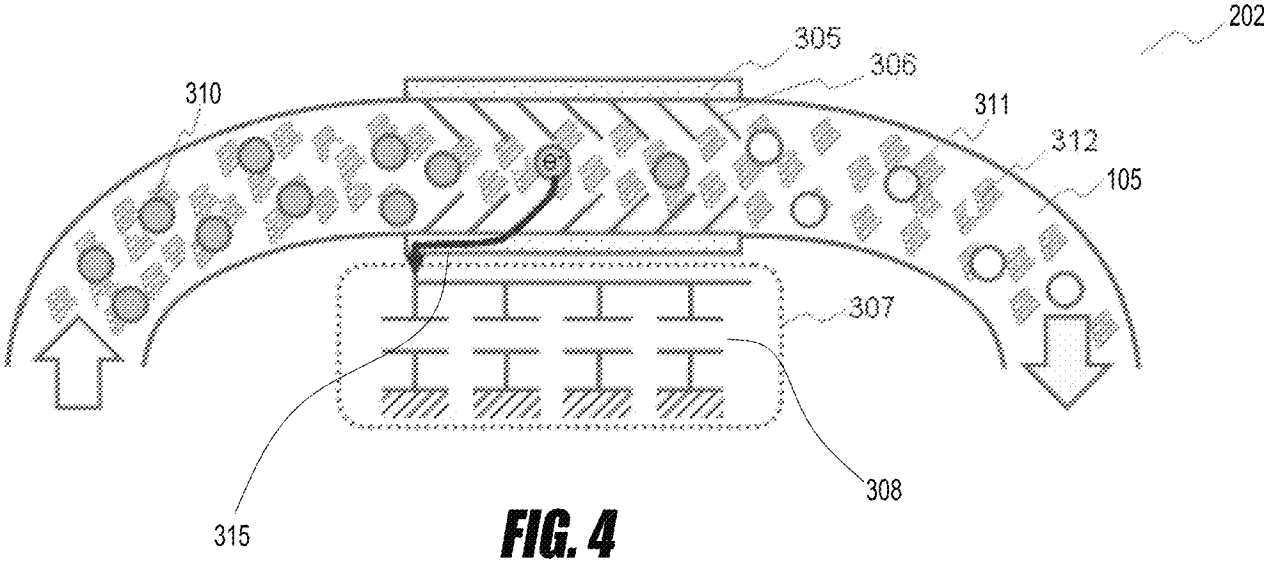
FIG. 4 is a drawing depicting some embodiments of charge collecting and/or a charging terminal including a conductive medium.

FIG. 4 is a drawing that depicts some embodiments of a conductive medium 312. In FIG. 4, line 315 represents an electron (e−) of a charged microparticle 310, which is transmitted in the presence of a conductive medium 312 from a charged microparticle to the brush 306 to one of the capacitors 308. A conductive medium is not required in all embodiments.

Percolation conduction, as discussed above, is a phenomenon in which, when the conductive substance added to an insulator reaches or exceeds a threshold such that a three-dimensional conductive network can be formed, causing the resistance to suddenly drop. This threshold is referred to as the "percolation threshold". One of skill in the art will be able to determine the appropriate conditions for this, for a given set of parameters. For example, for graphene, when the weight percent (wt %) of a functional graphene sheet (FGS) in PDMS in the dispersion fluid is 2.5% or larger, the resistance can drop from 1014 Ωcm to $10^{-1}$ Ωkm. For carbon nanotubes, when the wt % of CNT is 2.5% or larger, the resistance can drop from 1011Ωcm to 104 Ωcm. In some embodiments, a given system (of microparticles, conduits, and fluid (such as a conductive medium)) can be selected for even greater abilities to transmit electrical energy. In some embodiments, a percolation threshold is not achieved. In some embodiments, when the percolation threshold is, 2.5 wt %, by setting the percentage of the conductive medium to 2.5 wt % or greater, percolation conductivity can be established.

In some embodiments, the shape of the microparticles 104 is not limited. In some embodiments, the shape of the microparticle can be any shape, as long as fluidity is not significantly compromised. In some embodiments, the microparticles can be spherical, cubical, oval, conical, irregular, and/or randomly shaped. The size of the microparticles 104 can be selected from nanometers to millimeters, e.g., 1, 10, 100, 1000, 10,000, 100,000, 1,000,000, 10,000,000, or 999,000, 000 nm, including any range above any one of the preceding values and any range between any two of the preceding values. Because greater fluidity is ensured with decreasing size of the microparticles 104, such microparticles 104 readily follow the channel 106 shape before and after an elastic movement of the channel. However, since a reduction in the size of the microparticles 104 limits the amount of charge that can be stored, it can be desirable to design the microparticles 104 with a size corresponding to the amount of charge to be transmitted. Since, in some situation, there can be a tradeoff between the size of the conductive microparticles and fluidity, by appropriately arranging the size and the number of microparticles 104, the desired electric conductivity and fluidity can be achieved.

In some embodiments, a method of transmitting electricity is provided. In some embodiments, the method can include supplying an electrical charge to at least one microparticle at a first location, moving the at least one microparticle along a channel to a second location, and discharging the at least one microparticle at the second location, thereby transmitting electricity. In some embodiments the method further includes supplying a flowable medium. In some embodiments, the microparticles are dispersed in the flowable medium. In some embodiments, this occurs at or above the percolation threshold.

Methods of Manufacture

There are a variety of ways in which the various embodiments provided herein can be manufactured. FIGS. 6A-6H display some embodiments for manufacturing a conduit for a flexible circuit. In some embodiments, the method includes, but is not limited to, providing a flexible layer on a substrate, patterning at least one channel on the layer, and sealing the at least one layer. In some embodiments, the method can also include providing a flowable medium to the channel and suspending at least one microparticle within the flowable medium. In some embodiments, the flexible and/or stretchable conduit already exists and one only need add the microparticles and/or flowable medium and/or terminals.

One skilled in the art will appreciate that, for this and other processes and methods disclosed herein, the functions performed in the processes and methods can be implemented in differing order. Furthermore, the outlined steps and operations are only provided as examples, and some of the steps and operations can be optional, combined into fewer steps and operations or expanded into additional steps and operations without detracting from the essence of the disclosed embodiments.

Figure 6A:
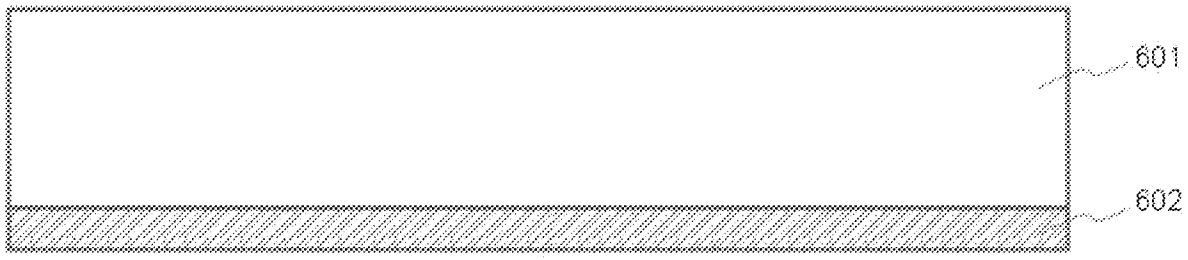
FIG. 6A is a drawing depicting some embodiments for a method of manufacturing a flexible conduit.

Referring to FIG. 6A, in some embodiments, a method for manufacturing a flexible conduit can include depositing a flexible layer 601 (such as an elastomer) on a substrate 602. In some embodiments, the flexible layer 601 can be a thermoplastic resin. In some embodiments, any flexible and/or stretchable material can be used. In some embodiments, the material is an insulating material. In some embodiments, for example when the conduit itself will be electrically isolated, the walls of the conduit need not be insulating. In some embodiments, the outside or inside of the conduit can be subsequently coated in an insulator.

In some embodiments, the flexible layer 601 can be deposited by spin coating.

Figure 6B:
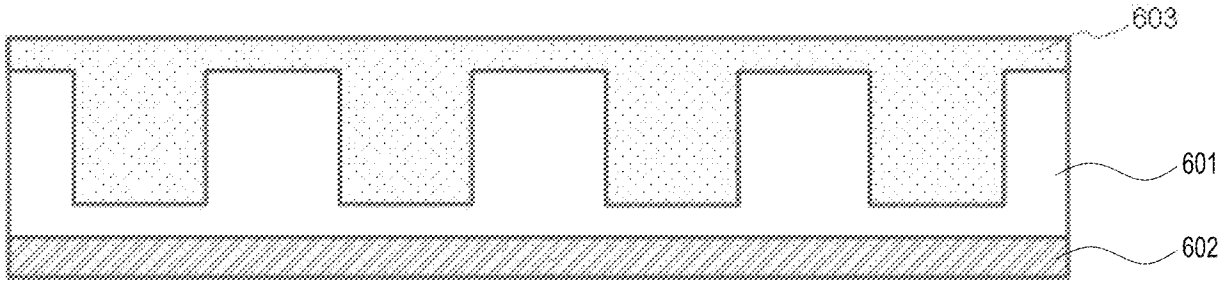
FIG. 6B is a drawing depicting some embodiments for a method of manufacturing a flexible conduit.

In some embodiments, the flexible layer 601 can be patterned. In some embodiments, the flexible layer 601 can be patterned by nanoimprinting. For example, as shown in FIG. 6B, in some embodiments, a mold 603 having a circuit pattern can be bonded to the flexible layer 601 and substrate 602. The flexible layer 601, substrate 602, and mold 603 can be fired at high temperature.

Figure 6C:
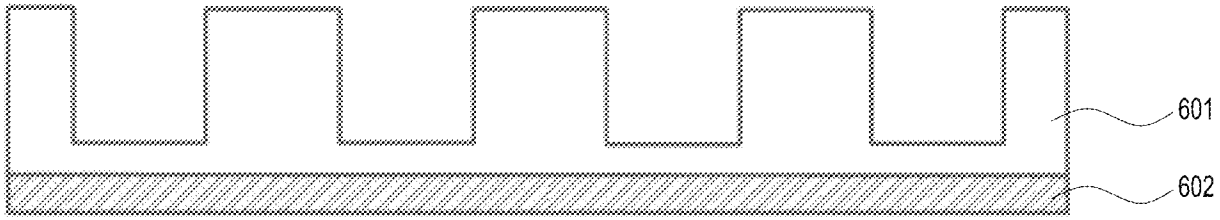
FIG. 6C is a drawing depicting some embodiments for a method of manufacturing a flexible conduit.

In some embodiments, as shown in FIG. 6C, the mold 603 is removed from the flexible layer 601 and the substrate 602 to form the channel space.

Figure 6D:
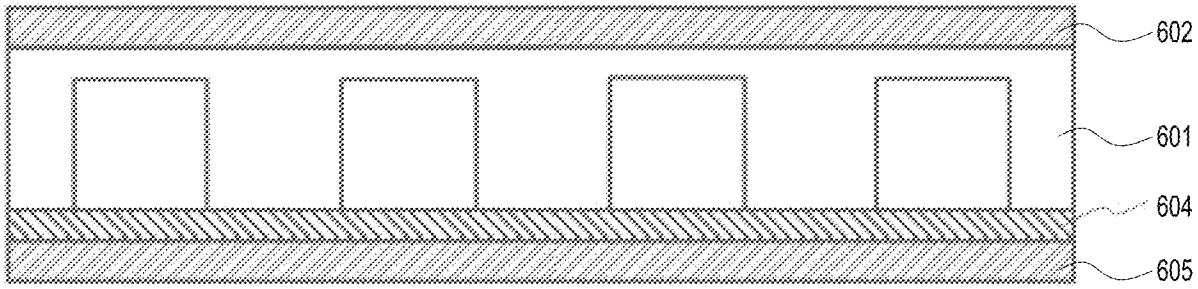
FIG. 6D is a drawing depicting some embodiments for a method of manufacturing a flexible conduit.

As shown in FIG. 6D, the flexible layer 601 can then be flipped over and attached to a sealing film or layer 604, which can be on a second substrate 605. In some embodiments, the sealing film 604 provides a hermetic seal 604 for the channel, between the walls of the channel and the film.

Figure 6E:
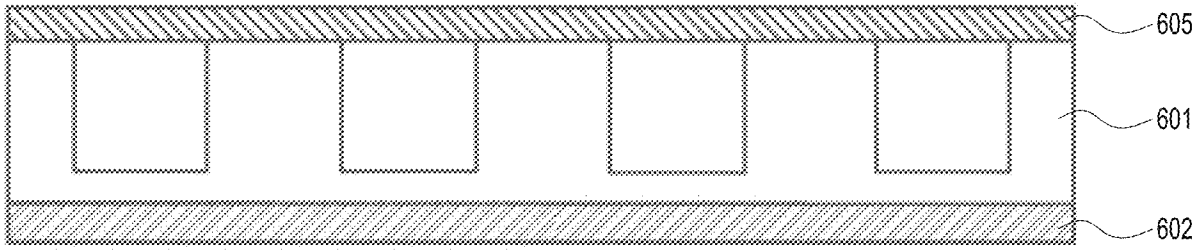
FIG. 6E is a drawing depicting some embodiments for a method of manufacturing a flexible conduit.
Figure 6F:
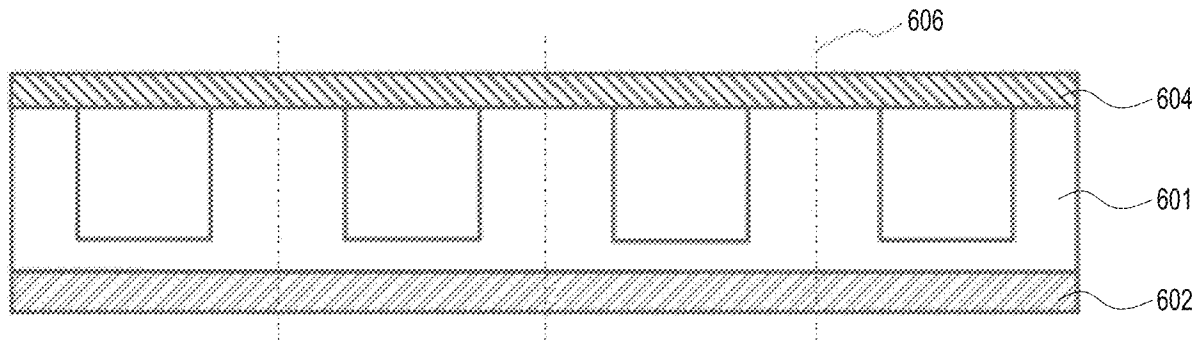
FIG. 6F is a drawing depicting some embodiments for a method of manufacturing a flexible conduit.

In some embodiments, the second substrate can then be removed (FIG. 6E).

Figure 6G:
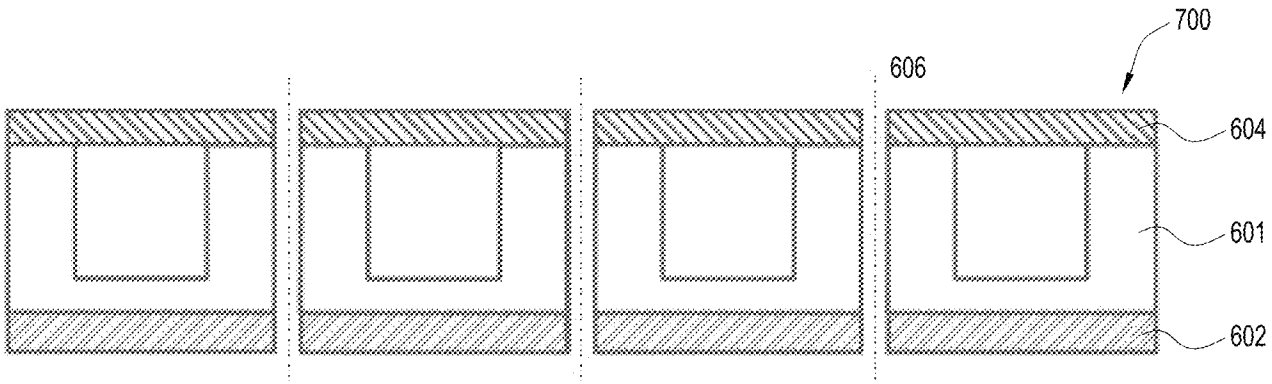
FIG. 6G is a drawing depicting some embodiments for a method of manufacturing a flexible conduit.
Figure 6H:
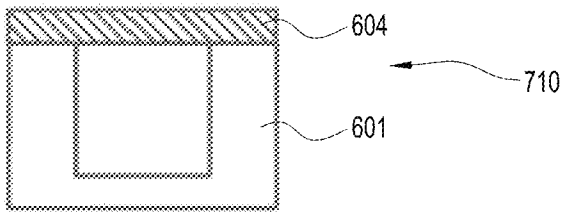
FIG. 6H is a drawing depicting some embodiments of a flexible conduit.

In some embodiments, the patterned flexible layer 601, sealing layer 604, and substrate 602 can be diced at desired position (e.g., 606). As shown in FIG. 6G, this results in separate, substrate attached conduits 700. In some embodiments, the substrate 602 can, optionally, be removed, resulting in one or more flexible conduits (710, FIG. 6H). In some embodiments, the conduit can then be filled with microparticles and/or fluids and/or other particles.

The method of producing a fluid circuit is not limited to the method described above and known MEMS techniques and nanoimprint techniques can be used.

Additional Embodiments

As noted above, in some embodiments, the channel 106 is flexible, stretchable or flexible and stretchable. In some embodiments, any type of flexibility and/or stretchability is adequate. In some embodiments, given the dynamic (flowing) nature of some embodiments, the flexibility is such that bends, kinks, etc. in the channel have a lower likelihood of causing obstructions in the flow channel. In some embodiments, the flexibility is such that an outer section of a bend stays somewhat away from the center and/or the inner section of a bend stays somewhat away from the center as well (e.g., the diameter and/or circumference of the channel remains approximately the same throughout the bend). An example of this is depicted in FIG. 7A (in the straight conformation) and 7B (in a flexed conformation). As shown in FIG. 7B, in some embodiments, the channel 106 can include an outer bending angle (θb), wherein a circumference of the channel 106 can be stretched at least πd(θb/360°) with its resting length. The parameters of the conduit are outlined below, where d is the thickness of the conduit, and l is the length of conduit, the stretched circumference is determined by:

$$C = d * \pi * \left(\frac{\theta b}{360°}\right) \text{ where } \theta_b = 180° - \theta_a$$

To determine the inner diameter reduction due to bending the conduit, one can use the following:

$$x_1 = \frac{d}{2}\cos\theta_c$$

$$x_0 = \frac{d}{2}\sin\theta_c$$

$$x_2 = \frac{d(1-\sin\theta_c)}{2}$$

$$x_3 = \tan\theta_c\left\{\frac{d(1-\sin\theta_c)}{2}\right\}$$

$$x_4 = \frac{d\{\cos\theta_c = \tan\theta_c(1-\sin\theta_c)\}}{2}$$

$$x_5 = \frac{d(1-\sin\theta_c)}{2\cos\theta_c} \text{ where } \theta_c = 90° - \theta_b$$

$$x_4 + x_5 = \frac{d\{(1-\sin\theta_c)(1-2\cos\theta_c\tan\theta_c) + 2(\cos\theta_c)^2\}}{2\cos\theta_c}$$

Using the above, one can arrange a conduit and/or bend in the conduit such that it remains highly efficient for flow through of the microparticles. In some embodiments, the circumference of the conduit throughout the bend does not appreciably decrease, e.g., it decreases less than 50% (e.g., 50, 45, 40, 35, 30, 25, 20, 15, 10, 9, 8, 7, 6, 5, 4, 3, 2, 1, 0.1, or 0% decrease in circumference, including any range beneath any one of the preceding values and any range between any two of the preceding values. In some embodiments, the conduit does decrease in circumference and/or diameter at bends.

In some embodiments, any one or more of the materials in table 1 can be used as the flexible material in the conduit.

TABLE 1

| | Q | NR | IR | IIR | FKM | BR | CR | SBR | EPDM | CSM |
|---|---|---|---|---|---|---|---|---|---|---|
| Hardness, JIS*[1] (degree) | 30~90 | 10~100 | 20~100 | 20~90 | 50~90 | 30~100 | 10~90 | 30~100 | 30~90 | 50~90 |

TABLE 1-continued

| | Q | NR | IR | IIR | FKM | BR | CR | SBR | EPDM | CSM |
|---|---|---|---|---|---|---|---|---|---|---|
| Tensile strength ($kg/cm^2$) | 40~100 | 30~300 | 50~200 | 50~150 | 70~200 | 20~200 | 50~250 | 50~200 | 50~200 | 70~200 |
| Extension percentage (%) | 50~500 | 100~1000 | 100~1000 | 100~1000 | 100~500 | 100~1000 | 100~1000 | 100~800 | 100~800 | 100~500 |

*[1]JIS: Japanese Industrial Standards, silicon rubber (Q), nitrile rubber (NR), isoprene rubber (IR), a polyisobutylene rubber (IIR), fluoro-rubber (FKM), butadiene rubber (BR), chloroprene rubber (CR), styrene-butadiene rubber (SBR), ethylene propylene diene rubber (EPDM), and chlorosulfonated polyethylene (CSM).

In some embodiments, an elastic conductor can be applied to higher-order devices. For example, high-performance robots, such as two-legged robots, require precise balance in their movement. Several hundred sensors are installed on the entire body of a robot, including limbs, joints, etc., to collect dynamic information at the points where the sensors are installed. By operating several hundred actuators based on the information collected and processed, the robot can move. In addition to the sensors and actuators, the robot requires information communication lines, power supply lines, etc. A large number of these lines are required to operate the installed sensors and actuators, which makes it difficult to provide optimal movement and design because the flexibility of the movement is reduced and the peripheral weight increases.

In some embodiments the conduit need not be on the microscale level. In some embodiments, the conduits can be the same as those used for transporting fluids in a dynamic situation, such as artificial blood vessel material. In some embodiments, such conduits can include a two-layer structure of a non-elastic interwoven layer and an elastic porous layer. In some embodiments, one can form the conduit on a coiled external wall to reduce kinking when the coil is bent.

EXAMPLES

Example 1

Method of Transmitting Energy

The present Example outlines a method of transmitting energy using a flexible circuit. A conduit including at least one channel configured to carry a flowable medium is provided. The conduit connects at least one charging terminal to at least one charge-collecting terminal. The charging terminal is connected to a DC power supply giving the electrical contact of the charging terminal the same electric potential as the DC power supply.

Contained in the channel is an insulating flowable medium with metal microparticles. The microparticles pass through the charging terminal where the microparticles contact the electrical contact of the charging terminal and become charged. The flowable medium with charged microparticles is then pumped from the charging terminal to a charge-collecting terminal at a flow rate of 1 $mm^2/s$ at 25° C. The charged microparticles contact the electrical contact of the charge-collecting terminal and are discharged. The electrical charge is stored in the capacitors of the charge-collecting terminal. Alternatively, the electrical charge can be used to provide electricity to a motor or other electrically driven device.

Example 2

Method of Making a Flexible Charge Carrying Conduit

The present Example outlines a method of making a flexible charge-carrying conduit. A flexible layer of silicone rubber is provided on a substrate. At least one channel is patterned on the flexible layer. The at least one channel is hermetically sealed with a silicone rubber sealing film to form a flexible conduit. The flexible conduit is then filled with a flowable medium and charge carrying microparticles. The ratio of flowable medium and microparticles is based on the materials of the flowable medium and microparticles and the calculated percolation threshold. The flexible circuit is filled with one of the following compositions:

Composition A: Grapheme microparticles at 2.5 wt % to a flowable medium.

Composition B: Carbon nanotube microparticles at 2.5 wt % to a flowable medium.

Composition C: Black lead microparticles at 31.15 wt % to a flowable medium.

Example 3

Method of Transmuting Energy

The flexible circuit of Example 2, including, composition A in a silicone oil flowable medium, is set up between a charging terminal that is supplied power by a battery and a charge-collecting terminal that is in electrical communication with an electrical motor. The grapheme microparticles are present at 2.5 wt % to the silicone oil. The grapheme microparticles pass through the charging terminal where the grapheme microparticles contact the electrical contact of the charging terminal and become charged. The silicone oil with charged grapheme microparticles is then pumped from the charging terminal to a charge-collecting terminal at a flow rate of 1 $mm^2/s$ at 25° C. The charged grapheme microparticles contact the electrical contact of the charge-collecting terminal and are discharged. The electrical charge is used to provide electricity to the motor.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations can be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims can contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications can be made without departing from the scope and spirit of the present disclosure. Accordingly, the various embodiments disclosed herein are not intended to be limiting, with the true scope and spirit being indicated by the following claims.

What is claimed is:

1. A conduit configured to carry charge, the conduit comprising:

at least one channel configured to contain a liquid;

at least one flowable medium within the at least one channel;

a plurality of microparticles suspended within the at least one flowable medium and configured to accept an electrical charge and donate the electrical charge, wherein the microparticles are present at a concentration of at least a percolation threshold in the at least one flowable medium so as to form a three-dimensional conductive network of the microparticles that spans the conduit, wherein the plurality of microparticles are at a high enough concentration in the at least one flowable medium such that they are in sufficiently close proximity to each other to transmit electrical charge between the microparticles and through the three-dimensional conductive network of the microparticles; and a temperature control element, which determines:

(a) a flow rate and/or viscosity of the at least one flowable medium, and/or (b) a conductivity of the microparticles.

2. The conduit of claim 1, wherein the at least one channel comprises at least one elastomer wall.

3. The conduit of claim 2, wherein the at least one elastomer wall comprises a heat resistant and elastic material.

4. The conduit of claim 2, wherein the at least one elastomer wall comprises a thermo-setting resin.

5. The conduit of claim 2, wherein the at least one elastomer wall comprises at least one of a silicon rubber (Q), a natural rubber, an acrylic rubber (including polyacrylic rubber (ACM, ABM)), a nitrile rubber, an isoprene rubber (IR), a polyisobutylene rubber (IIR), a urethane rubber, a fluororubber (FKM) (including fluorosilicone rubber (FVMQ)), a polyisoprene rubber, a butadiene rubber (BR), a polybutadiene rubber, a chloroprene rubber (CR), polychloroprene, neoprene, baypren (R), a butyl rubber, styrene-butadiene rubber (SBR), an ethylene propylene rubber (EPM), an ethylene propylene diene rubber (EPDM), an epichlorohydrin rubber (ECO), fluoroelastomers (FKM and FEPM), chlorosulfonated polyethylene (CSM), or ethylene-vinyl acetate (EVA).

6. The conduit of claim 1, wherein at least a portion of the at least one channel is sealed with a sealant film so as to contain the at least one flowable medium.

7. The conduit of claim 1, wherein the microparticles comprise:

a ceramic core; and a metal shell.

8. The conduit of claim 1, wherein the microparticles comprise at least one of carbon, graphene, graphite, fullerene, carbon nanotubes, carbon black, carbon fiber, black lead, or a mixture thereof.

9. The conduit of claim 1, wherein the microparticles comprise a conductive polymer.

10. The conduit of claim 1, wherein the microparticles comprise graphene and the microparticles are present at about 2.5 wt % to the at least one flowable medium.

11. The conduit of claim 1, wherein the at least one channel is flexible, stretchable, or flexible and stretchable.

12. The conduit of claim 1, wherein the at least one channel comprises an outer bending angle ($\theta b$), wherein a circumference of the at least one channel can be stretched at least $\pi d(\theta b/360°)$ with its resting length.

13. A flow based electrical circuit, comprising:

a conduit configured to carry charge, the conduit comprising:

at least one channel configured to contain a liquid;

at least one flowable medium within the at least one channel;

a plurality of microparticles suspended within the at least one flowable medium, wherein the microparticles are present at a concentration of at least a percolation threshold in the at least one flowable medium so as to form a three-dimensional conductive network of the microparticles that spans the conduit, wherein the plurality of microparticles are at a high enough concentration in the at least one flowable medium such that they are in sufficiently close proximity to each other to transmit electrical charge between the microparticles and through the three-dimensional conductive network of the microparticles;

a temperature control element, which determines:

(a) a flow rate and/or viscosity of the at least one flowable medium, and/or (b) a conductivity of the microparticles;

at least one charge-collection terminal coupled to and configured to collect charge from the plurality of microparticles; and at least one charger terminal coupled to and configured to donate electrical charge to the plurality of microparticles.

14. The flow based electrical circuit of claim 13, wherein the at least one charge-collection terminal comprises:

at least one metal plate coupled to the microparticles, wherein the microparticles are suspended within the at least one flowable medium;

at least one metal brush coupled to the microparticles, wherein the microparticles are suspended within the at least one flowable medium; and at least one charger coupled to the at least one metal plate and the at least one metal brush.

15. The flow based electrical circuit of claim 14, wherein the at least one metal plate comprises a zig-zag surface.

16. The flow based electrical circuit of claim 14, wherein the at least one charger comprises a first capacitor.

17. The flow based electrical circuit of claim 13, wherein the at least one charge-collection terminal comprises at least one of: a transistor, a bit line, a plate line, or a word line.

18. A method to transmit electricity, the method comprising:

receiving an electrical charge by a first microparticle at a first location in a conduit, wherein the conduit comprises:

at least one channel configured to contain a liquid;

at least one flowable medium within the at least one channel;

a plurality of microparticles suspended within the at least one flowable medium, wherein the microparticles are present at a concentration of at least a percolation threshold in the at least one flowable medium so as to form a three-dimensional conductive network of the microparticles that spans the conduit, wherein the plurality of microparticles are at a high enough concentration in the at least one flowable medium such that they are in sufficiently close proximity to each other to transmit electrical charge between the microparticles and through the three-dimensional conductive network of the microparticles; and a temperature control element, which determines:

(a) a flow rate and/or viscosity of the flowable medium, and/or (b) a conductivity of microparticles; and transmitting the electrical charge from the first microparticle to a second microparticle at a second location in the conduit, thereby transmitting electricity.

19. The method of claim 18, further comprising moving the at least one flowable medium within the at least one channel, wherein the plurality of microparticles move at a flow rate of about a kinetic viscosity of the at least one flowable medium or less.

20. The method of claim 18, wherein receiving the electrical charge with the at least one microparticle comprises using percolation conduction.

21. A flow based electrical circuit, comprising, a conduit configured to carry charge, the conduit including:

at least one channel configured to contain a liquid;

at least one flowable medium within the at least one channel and configured to move within the at least one channel; and a plurality of microparticles suspended within the at least one flowable medium and configured to accept an electrical charge by use of percolation conduction and donate the electrical charge, wherein the microparticles are present at a concentration of at least a percolation threshold in the at least one flowable medium so as to form a three-dimensional conductive network of the microparticles that spans the conduit, wherein the plurality of microparticles are at a high enough concentration in the at least one flowable medium such that they are in sufficiently close proximity to each other to transmit electrical charge between the microparticles and through the three-dimensional conductive network of the microparticles;

at least one charge-collection terminal coupled to and configured to collect charge from the plurality of microparticles, wherein the at least one charge-collection terminal includes at least one metal plate that has a zig-zag surface, at least one metal brush, and at least one charger that comprises a capacitor;

at least one charger terminal coupled to and configured to donate electrical charge to the plurality of microparticles; and a temperature control element configured to use temperature to control at least one of conductivity, flow rate, or viscosity, wherein the at least one channel comprises at least one elastomer wall, wherein at least some of the microparticles include an electrically conductive material formed as a ceramic core and a metal shell, wherein at least others of the microparticles include a conductive polymer, wherein at least others of the microparticles include at least one of carbon, graphene, graphite, fullerene, carbon nanotubes, carbon black, carbon fiber, black lead, or a mixture thereof, wherein the at least one charge-collection terminal further comprises at least one of: a transistor, a bit line, a plate line, or a word line, and wherein the plurality of microparticles is configured to move at a flow rate of about a kinetic viscosity of the at least one flowable medium or less.

* * * * *